US005890622A

United States Patent [19]

Farmont

[11] Patent Number: 5,890,622

[45] Date of Patent: Apr. 6, 1999

[54] DISPENSER FOR DISC-SHAPED CAR-PARK TICKET

[75] Inventor: Hans Farmont, Ratingen, Germany

[73] Assignee: Farmont Technik GmbH & Co. KG, Dusseldorf, Germany

[21] Appl. No.: 792,937

[22] Filed: Jan. 23, 1997

[30] Foreign Application Priority Data

Sep. 19, 1996 [DE] Germany ..... 196 38 285.8
Jan. 7, 1997 [DE] Germany ..... 297 00 112.4

[51] Int. Cl.[6] ..... B65H 5/08

[52] U.S. Cl. ..... 221/13; 194/902; 221/192; 221/203; 221/258; 221/265; 221/277

[58] Field of Search ..... 194/902; 453/57, 453/49; 221/13, 14, 192, 203, 254, 258, 265, 277

[56] References Cited

U.S. PATENT DOCUMENTS

| | | | |
|---|---|---|---|
| 2,063,356 | 12/1936 | Wiggins | 194/4 |
| 3,397,764 | 8/1968 | Simjian | 194/4 |
| 3,766,452 | 10/1973 | Burpee et al. | 317/262 R |
| 4,101,701 | 7/1978 | Gordon | 428/189 |
| 4,257,436 | 3/1981 | Smith | 133/5 R |
| 4,319,674 | 3/1982 | Riggs et al. | 194/4 R |
| 4,380,699 | 4/1983 | Monnier et al. | 235/492 |
| 4,395,043 | 7/1983 | Gargione | 273/239 |
| 4,518,001 | 5/1985 | Branham | 453/49 |
| 4,585,930 | 4/1986 | Casden | 235/449 |
| 4,674,618 | 6/1987 | Eglise et al. | 194/210 |
| 4,703,164 | 10/1987 | von Ballmoos | 235/384 |
| 4,717,815 | 1/1988 | Tomer | 235/378 |
| 4,788,102 | 11/1988 | Koning et al. | 428/40 |
| 4,865,222 | 9/1989 | Sullivan | 221/241 |
| 4,868,373 | 9/1989 | Opheij et al. | 235/380 |
| 4,926,996 | 5/1990 | Eglise e al. | 194/212 |
| 4,960,983 | 10/1990 | Inoue | 235/449 |
| 4,969,549 | 11/1990 | Eglise | 194/205 |
| 4,982,070 | 1/1991 | Bezin et al. | 235/378 |
| 5,125,493 | 6/1992 | Abe | 453/57 |
| 5,206,495 | 4/1993 | Kreft | 235/492 |
| 5,208,110 | 5/1993 | Smith et al. | 428/414 |
| 5,484,334 | 1/1996 | Evdokimo | 221/203 |

FOREIGN PATENT DOCUMENTS

| | | | |
|---|---|---|---|
| 391375 B | 9/1990 | Austria . | |
| 0402821 | 12/1990 | European Pat. Off. . | |
| 2266229 | 3/1974 | France . | |
| 87 18270 | 6/1989 | France . | |
| 2231720 | 1/1973 | Germany . | |
| 25 57 984 | 6/1977 | Germany . | |
| 26 28 595 | 1/1978 | Germany . | |
| 29 26 867 | 1/1981 | Germany . | |
| 3307986 | 9/1983 | Germany . | |
| 3339387 | 5/1984 | Germany . | |
| 3608165 | 9/1986 | Germany . | |
| 4021770 | 1/1992 | Germany . | |
| 9407260.4 | 6/1994 | Germany . | |
| 60-215288 | 10/1985 | Japan . | |
| 0304595 | 12/1989 | Japan | 453/57 |
| 4-4495 | 1/1992 | Japan . | |
| 5-189626 | 7/1993 | Japan . | |
| 654 942 | 3/1986 | Switzerland . | |
| 124 | 1/1854 | United Kingdom . | |
| WO89/12286 | 12/1989 | WIPO . | |
| WO91/14237 | 9/1991 | WIPO . | |

*Primary Examiner*—H. Grant Skaggs
*Attorney, Agent, or Firm*—Steven F. Caserza; Flehr Hohbach Test Albritton & Herbert LLP

[57] ABSTRACT

A dispenser for disc-shaped car-park tickets which makes it possible on a permanent basis for the car-park tickets provided for issuing to be made available reliably, as required, from a supply of car-park tickets, and which is of simple design. The dispenser separates car-park tickets coming from a supply container and moves them, in a pushed group, through a transporting duct which bridges a spatial distance between the supply container and the issuing apparatus. In addition to the spatial distance bridged, a vertical ascent is also surmounted, in order that the car-park tickets can be moved into the issuing apparatus and issued from the same under the action of gravity. Further configurations of the invention can be gathered from the claims and from the following description.

14 Claims, 5 Drawing Sheets

DISPENSER FOR DISC-SHAPED CAR-PARK TICKET

FIELD OF THE INVENTION

The invention relates to a dispenser for a disc-shaped car-park ticket.

PRIOR ART

Upon entrance into charge-related multi-story car parks, outdoor parking lots, or the like, car-park users are issued with disc-shaped car-park tickets which are used for billing parking and, if appropriate, also for actuating a departure barrier at the end of a parking period. The issuing of car-park tickets, which is necessary for this purpose, in the entrance region requires an entrance control station with an issuing apparatus and an associated dispenser to be set up, the latter storing the car-park tickets and supplying the issuing apparatus with car-park tickets as required in order that said apparatus can issue the car-park tickets to car-park users upon request.

If the car-park tickets are car-park tickets which can be issued repeatedly and have an identification and/or communication element then, in contrast to the hitherto conventional car-park tickets consisting of paper, these car-park tickets are of a more compact design and usually consist of a stiff material, which makes it more difficult to issue the car-park tickets separately, i.e. to issue a car-park ticket upon request.

SUMMARY

The object of the invention is thus to provide a dispenser for disc-shaped car-park tickets which makes it possible on a permanent basis for the car-park tickets provided for issuing to be made available reliably, as required, from a supply of car-park tickets, and which is of simple design.

This provides a dispenser which separates car-park tickets coming from a supply container and moves them, in a pushed group, through a transporting duct which bridges a spatial distance between the supply container and the issuing apparatus. In addition to the spatial distance bridged, a vertical ascent is also surmounted, in order that the car-park tickets can be moved into the issuing apparatus and issued from the same under the action of gravity. Further configurations of the invention can be gathered from the claims and from the following description.

BRIEF DESCRIPTION OF THE DRAWINGS

The invention is explained in more detail herein below with reference to the exemplary embodiments illustrated in the accompanying drawings, in which.

DETAILED DESCRIPTION

Figure 1B:
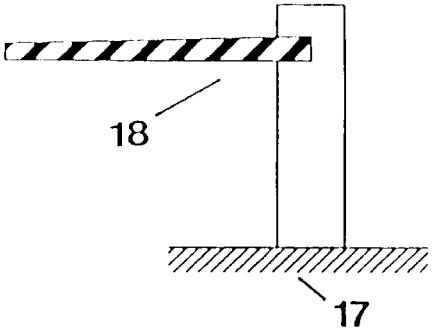
FIG. 1*b* shows, schematically, a parking barrier which can be connected up to the entrance-control and departure-control station according to FIG. 1*a,*

The first exemplary embodiment, which is illustrated in FIG. 1, of an entrance-control and departure control station for charge-related car parks comprises an entrance-control station 1 and a departure-control station 2 which are installed in a common housing 3 or in adjacent housings. Accordingly, the first exemplary embodiment relates to a combined entrance-control and departure-control station which issues and retrieves reusable car-park tickets 4.

The car-park tickets 4 are disc-shaped car-park tickets consisting of an essentially stiff or rigid material, for example, plastic. It is possible to select the outer configuration of the car-park tickets 4. However, round car-park tickets 4 are preferred since the rolling capacity thereof improves the conveyability. The thickness of the car-park tickets 4, or their border configuration, is selected such that the car-park tickets have a circumferential running and contact surface which has a width of from 2 to 8 mm. Furthermore, an identification element and, if appropriate, a communication element with a selectable code, which can be read by the entrance-control and departure-control station, are integrated in the car-park tickets 4.

The departure-control station 2 comprises a departure-side retrieval apparatus 5 which comprises a downwardly directed shaft 6. The downwardly directed shaft 6 extends from a car-park-ticket-collection opening 7, which is located in a departure-side housing wall 8, and is of such dimensions that the car-park tickets 4 can roll or slide down the downwardly directed shaft 6 on their circumferential surface and cannot fall over out of this position. A base surface 9 of the downwardly directed shaft 6 then forms a running surface for the car-park tickets 4.

Provided at an initial section 10 of the downwardly directed shaft 6 is a read and, if appropriate, communication device 11 by means of which a car-park ticket 4 which has been introduced through the collection opening 7 by a departing car-park user can be read and, if appropriate, recorded on. The read and, if appropriate, communication device 11 may be formed, in a known manner, by a read head, if appropriate combined with a write head. The read and, if appropriate, communication device 11 is connected to a control device 12 which processes the read values for activating further devices which may be connected to the control device 11.

Provided downstream of the location where the read and, if appropriate, communication device 11 is arranged is a blocking device 13 by means of which the downwardly directed shaft 6 can be closed or released in order to retain the car-park tickets 4 for a selectable time span in the range of action of the read and, if appropriate, communication device 11. The directions in which the blocking device 13 can be displaced are marked by a double arrow. The position of the blocking device 13 in the release position is illustrated by dashed lines and the position of the blocking device 13 in the blocking position is illustrated by solid linen. For actuating the blocking device 13, the latter is connected to the control device 12.

Furthermore, the retrieval apparatus 5 may comprise a downwardly directed reject shaft 14, which branches off from the downwardly directed shaft 6 downstream of the read and, if appropriate, communication device 11 and runs to a reject opening 15 in the departure-side housing wall 8. Car-park tickets 4 which are not authorized for departure by the read and, if appropriate, communication device 11 can be given back to a car-park user via said downwardly directed reject shaft 14. For redirecting a car-park ticket 4 which has been introduced into the downwardly directed shaft 6, there is provided in said downwardly directly reject shaft 14 a rocker or a transverse pin 16 whose region for pivoting into and out of the downwardly directed shaft 6 is marked by a double arrow. The actuation of the rocker 16 is triggered via the control device 12, for which reason it is connected to the control device 12.

Furthermore, a parking barrier 18 (cf. FIG. 1*b*) which crosses a roadway 17 may also be connected to the control device 12 in order to be opened and closed. The control device may further be connected to a pay station (not shown) in order for the latter to signal departure authorization for a car-park ticket 4, in particular identified by its code.

Arranged downstream of the retrieval apparatus 5 is at least one pushing device 19, which belongs to a dispenser 20, which in this case forms a car-park-ticket return device and connects the retrieval apparatus 5, to an entrance-side issuing apparatus 40. In addition to the at least one pushing device 19, the dispenser 20 comprises a transporting duct 21, of which an inlet 22 adjoins an outlet 23 of the pushing device 19 and an outlet 24 adjoins the entrance-side issuing apparatus 40. Since the downwardly directed shaft 6 adjoins the pushing device 19 and thus feeds to the pushing device 19 the car-park tickets 4 which have been returned by the car-park users, said pushing device can convey the received packing tickets 4 into the transporting duct 21, which directs the car-park tickets to the entrance-side issuing apparatus 40.

Figure 1C:
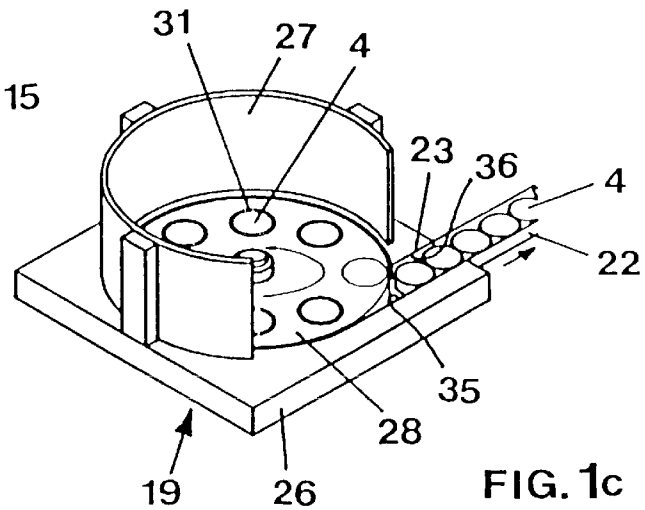
FIG. 1*c* shows, schematically, a lateral front view of the pushing device according FIG. 1*a,*

The pushing device 19 is preferably formed by a driving plate, as is illustrated in FIG. 1*c*. The driving plate comprises a combined car-park-ticket-separating and driving device 26 and a supply container 27 which is positioned thereon and is intended for receiving a plurality of car-park tickets 4. The car-park-ticket separating and driving device 26 forms a base of the supply container 27. The car-park-ticket-separating and driving device comprises a car-park-ticket-fishing disc which is formed by a perforated disc 28 (see FIGS. 3 and 4) which is mounted rotatably over a guide path 29 (see FIGS. 5 and 6) and can be driven in a continuous or stepwise manner by means of a motor 30.

Figure 3:
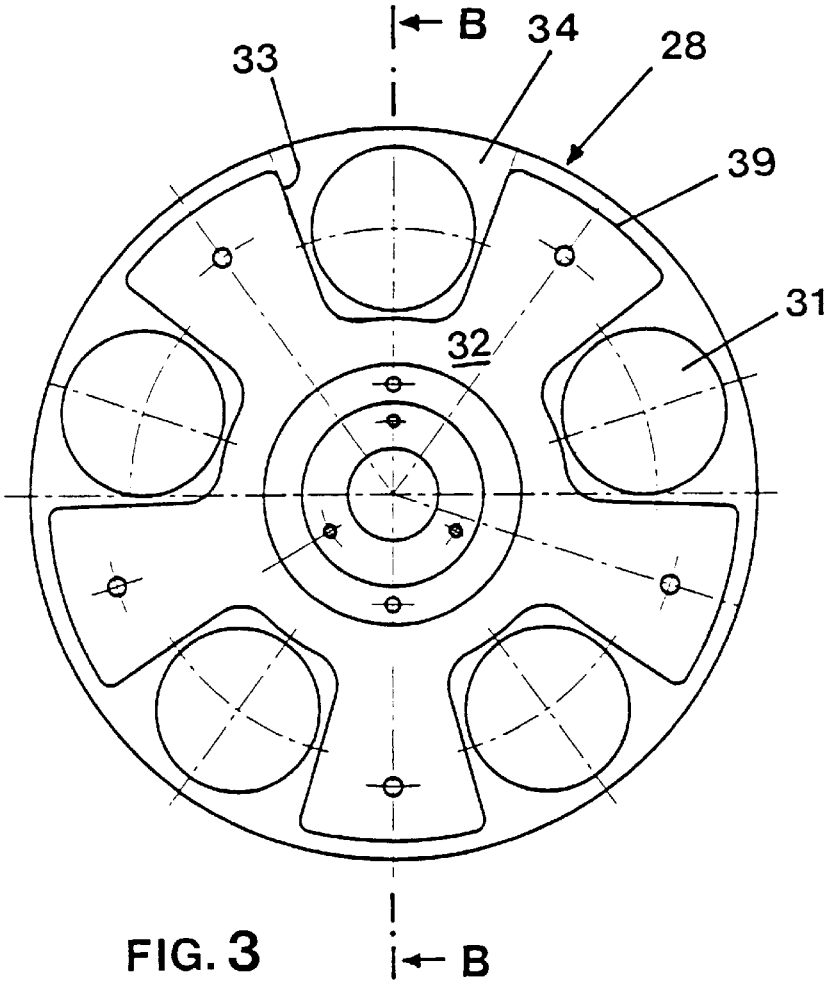
FIG. 3 shows a bottom view of a car-park-ticket-intercepting and driving disc.
Figure 4:
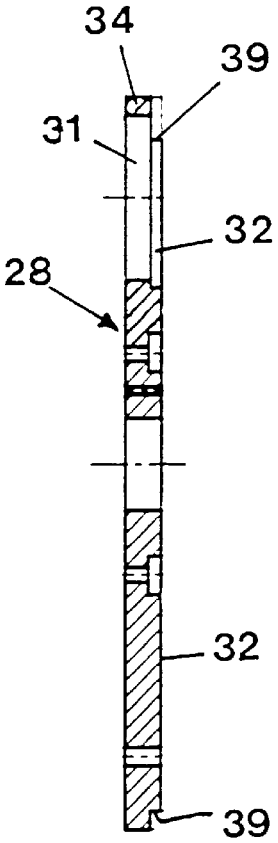
FIG. 4 shows a section along B—B of FIG. 3.

As can be seen from FIGS. 1*c*, 3 and 4, the perforated disc 28 has a plurality of concentrically arranged holes 31. Since, in accordance with the exemplary embodiment described, use of made of round car-park tickets 4, the holes 31 are round cutouts, the diameter of which slightly exceeds the diameter of the car-park tickets 4 in order that the latter can slide into the holes 31 and can drop through these into the guide path 29 located there beneath. The perforated disc 28 according to FIG. 1*c* differs from the perforated disc 28 according to FIG. 4 in terms of the number of holes 31. The perforated discs 28 are otherwise of the same design, so, as far as a detailed description is concerned, you are referred to the perforated disc 28 illustrated in FIGS. 4 and 5.

In addition to a number of holes 31, the perforated disc 28 has guide webs 32 which project on the rear side and by means of which the perforated disc 28 engages in the guide path 29. The guide path 29, which is formed by a curved groove which follows the circle of the concentrically arranged holes 31, has a depth which is matched to the thickness of the car-park tickets 4, to be precise such that the car-park tickets 4 are received by it in such a manner that the car-park tickets 4 which have dropped in are only gripped by the guide webs 32, and thus a perforated-disc plate 34 from which the guide webs 32 project on the rear side can move over car-park tickets 4 guided in the guide path 29.

The guide webs 32 enclose each hole 31 in a mouth-like manner by means of a circumferential mouth opening 33, through which a car-park ticket 4 can be discharged. Accordingly, a car-park ticket 4 intercepted by a hole 31 drops through the hole 31 into the guide path 29 arranged there beneath and, as the perforated disc 28 rotates in the direction of an outlet 23, is retained in the region of the respective hole 31 by the guide webs 32, enclosing the respective hole 31 in a mouth-like manner, and moved along. The direction of rotation depends on the selectable direction of the outlets 23.

Figure 5:
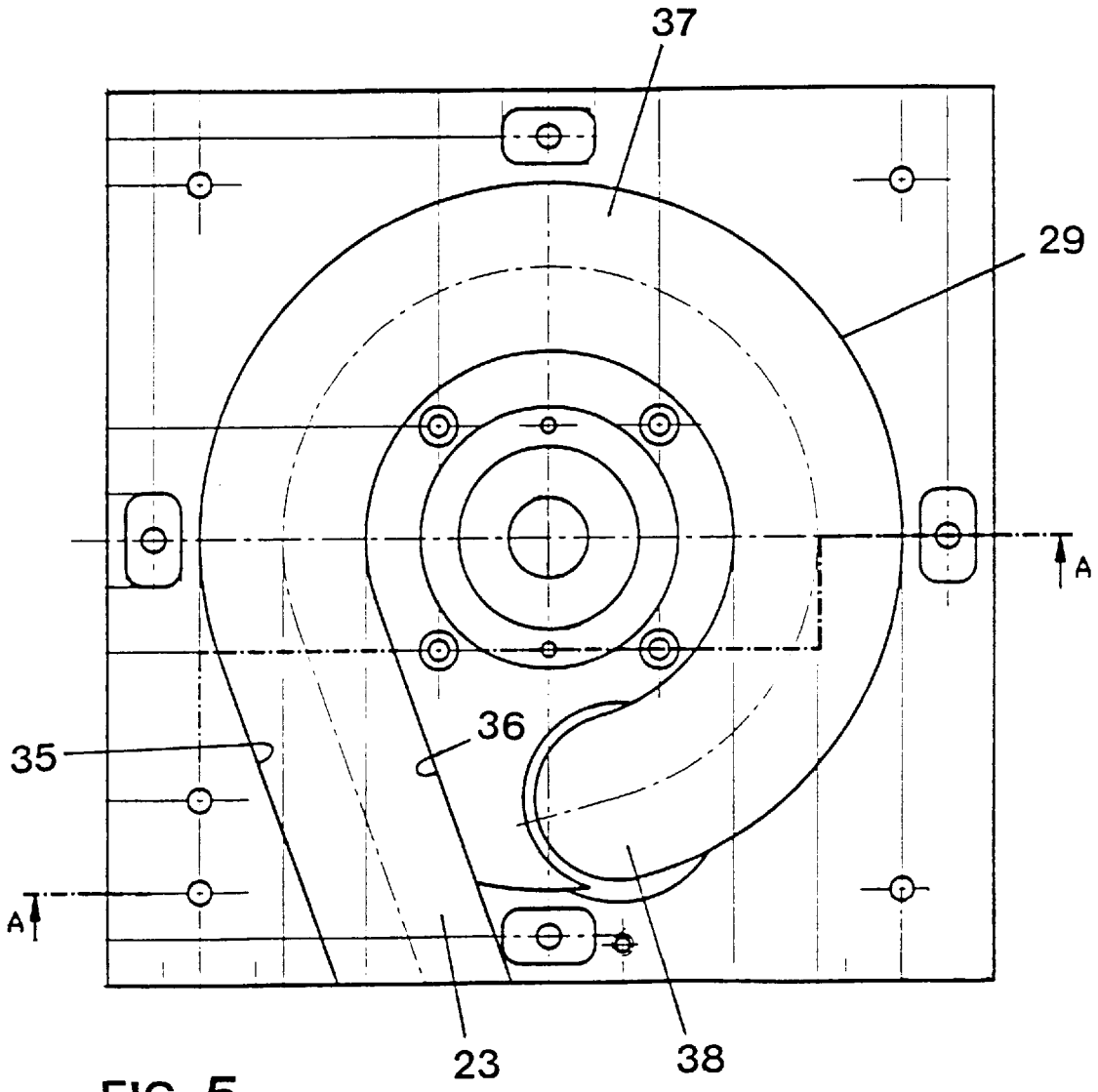
FIG. 5 shows a plan view of a guide path of a pushing device which interacts with the car-park-ticket intercepting and driving disc according to FIG. 3.
Figure 6:
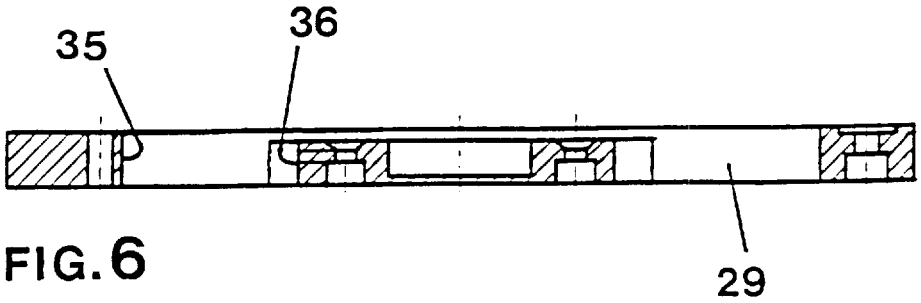
FIG. 6 shows a section along A—A of FIG. 5.

As is illustrated in FIGS. 1*c* and 5, the guide path 29 ends in an outlet 23 which is formed by a curved outlet and forms a discharge, which is rectilinear here. This outlet 23 has lateral delimiting borders 35, 36 for positively guiding into the outlet 23 the car-park tickets running in the guide path 29. On account of the rotary movement of the perforated disc 28 and the positive guidance into the outlet 23, the car-park tickets 4 running in the guide path are moved out of the perforated disc 28 through the mouth opening 33.

The guide path 29 thus has a loop-shaped configuration, an arc 37 of the loop being arranged on the arc of the circular arrangement of the holes 31, and a dead end 38 being provided at a selectable loop-arc section, said dead end 38 being selected such that the arc 37, which constitutes the intercepting section for the car-park tickets 4 in the supply container 27 and thus ensures the separation of the car-park tickets 4, is as long as possible. According to FIG. 5, the dead end 38 is adjacent to the outlet 23.

As is illustrated in FIGS. 3 and 4, the guide webs 32 which project from the rear side not only enclose the holes 31 in a mouth-like manner, but also comprise border-side, second guide webs 39 which run, parallel to the circumferential surface, between two mouth openings 34 in each case. These second guide webs 39 form pushing and supporting surfaces for in each case one car-park ticket 4 conveyed into the outlet 23 by the perforated disc 28.

As can be seen, in particular, from FIG. 1*c*, the perforated disc 28 moves the car-park tickets 4 one after the other into the outlet 23 and from there into the transporting duct 21. The second guide webs 39 have the effect that, as the perforated disc 28 continues to rotate, a car-park ticket 4 which has been moved into the outlet 23 is pushed forwards and also supported in the process. As soon as the perforated disc 28 moves the next car-park ticket 4 into the outlet, this car-park ticket 4 which has just newly passed into the outlet 23 exerts a pushing movement on the car-park tickets 4 which are already located in the outlet and is itself conveyed through the outlet by the second guide webs 39. A pushed group 41 comprising car-park tickets 4 located loosely one behind the other under the action of gravity is thus formed in the outlet 23 and the adjoining transporting duct 21, the respectively last car-park ticket 4 conveyed into the outlet 23 by the perforated disc 28 forming the lowermost car-park ticket of a series of car-park tickets 4, which lowermost car-park ticket transmits the pushing movement to the pushed group 41 of car-park tickets 4 in the transporting duct 21, i.e. the forwards movement of the lowermost car-park ticket moves the entire pushed group 41 forwards by the length of one car-park ticket 4. Consequently, a car-park-ticket stream is conveyed through the transporting duct 21.

The direction of movement of the pushed group 41 is illustrated by an arrow in FIG. 1*c*.

Figure 1A:
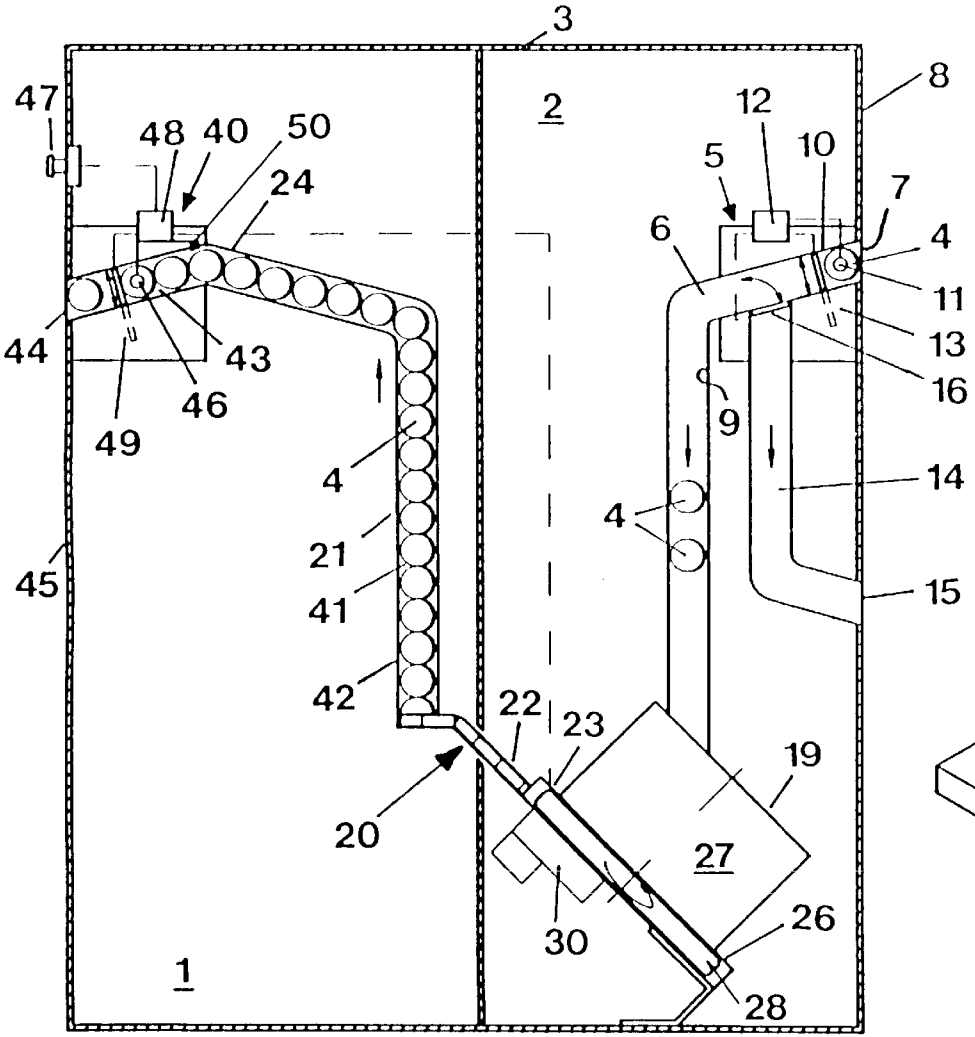
FIG. 1*a* shows, schematically and partially in section, a front view of a first exemplary embodiment of an entrance-control and departure-control station.

It is advantageous here if the pushing device 19 has a perforated disc 28 which is set up in an obliquely upright manner, as illustrated in FIG. 1*a*. This facilitates the fishing of the car-park tickets 4 by the perforated disc 28, and thus the separation of said car-park tickets 4. Furthermore, the outlet 23 may be arranged at the top of the pushing device 19 and form a type of downwardly directed shaft, which improves the structure of the pushed group 41.

The transporting duct 21 adjoining the pushing device 19 adjoins the outlet 23 of the pushing device 19, in which the pushed group 41 moves forwards, by means of at least one ascending section 42. The vertical ascent achieved by the ascending section is preferably selected such that the outlet 24 of the transporting duct transfers the dispensed car-park tickets 4 to the issuing apparatus 40 at a level at which the car-park tickets 4 can be issued via a downwardly directed shaft 43 provided in the issuing apparatus 40. Said downwardly directed shaft 43 ends in an issuing opening 44 in the entrance side housing wall 45, the issuing opening 44 and the retrieval opening 7 preferably being located at the same, car-park user-friendly level.

The cross-section of the transporting duct 21 is selected such that the latter guides the car-park tickets in an upright, rollable position, as is illustrated in FIG. 1*a*. It is possible to select the length of the transporting duct 21, it being possible to combine sections with different vertical ascents. Curved sections may also be included.

Similarly to the retrieval apparatus 5, the issuing apparatus 40 is equipped with a read and, if appropriate, communication device 46 by means of which a car-park ticket 4 which is to be issued to an entering car-park user by the actuation of a request button 47 is read and, if appropriate, recorded on. The read and, if appropriate communication device 46 may be formed, in a known manner, by a read head, if appropriate combined with a write head. The read and, if appropriate, communication device 46 is connected to a control device 48 which processes the read values for activating further devices which may be connected to the control device 48.

Provided downstream of the location where the read and, if appropriate, communication device 46 is arranged is a blocking device 49 by means of which the downwardly directed shaft 43 can be closed or released in order to issue a car-park ticket 4 in each case only upon request. The direction in which the blocking device 49 can be displaced is marked by a double arrow. The position of the blocking device 49 in the release position is illustrated by dashed lines and the position of the blocking device 49 in the blocking position is illustrated by solid lines. For actuating the blocking device 49, the latter is connected to the control device 48.

The control devices 12, 48 may be combined to give a common control device. In addition, the drive 30 for actuating the pushing device 19 is connected to at least one control device 12, 48, preferably the control device 48 of the issuing apparatus 40. The pushing device 19 may be activated, and new car-park tickets returned from the retrieval apparatus 5 to the issuing apparatus 14, as required and in dependence on the filling level in the issuing apparatus 40, in particular in the downwardly directed shaft 43. For this purpose, a filling-level monitor 50, which is likewise connected to the control device 48, may be provided in the downwardly directed shaft 43 of the issuing apparatus 40. The operations of retrieving the car-park tickets 4, returning the latter by the operation of the pushing device 19 and issuing the car-park tickets can be coordinated with one another such that the car-park tickets 4 pass through continuously. The interposition of buffer sections and/or supply containers, in particular supply container 27 of the pushing device 19, increases the flexibility of the system.

The connections of the control devices 12, 48 to the various components described above are illustrated by dashed lines.

In accordance with a development of the first exemplary embodiment of FIGS. 1*a* to 1*c*, there may be arranged upstream of the issuing apparatus 40 a supply container into which the dispenser 20 conveys and from which the issuing apparatus 40 removes the car-park tickets to be issued as required.

The above described entrance-control and departure-control station operates as follows: a car-park car-park user who wishes to drive out at the end of a parking period introduces into the departure collection opening 7 his or her car-park ticket 4 which has been authorized for departure, as a result of which this ticket passes into the downwardly directed shaft 6 of the retrieval apparatus 5. The car-park ticket 4, in particular its code, is read at the read, and if appropriate, communication device. If a control device 12 is provided with a departure authorization for this code, then the parking barrier 18 is opened and the retrieved car-park ticket 4 drops, via the downwardly directed shaft 6, into the dispenser 20 for the issuing apparatus 40 of the entrance-control station 1.

Figure 2B:
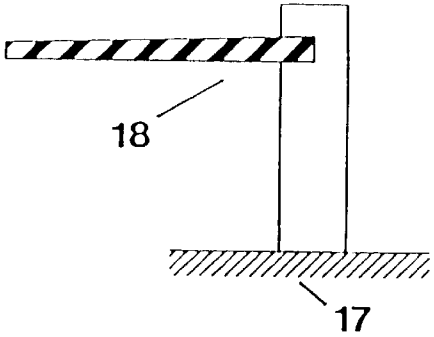
FIG. 2*b* shows, schematically, a parking barrier which can be connected up to the entrance-control station according to FIG. 2*a,*
Figure 2C:
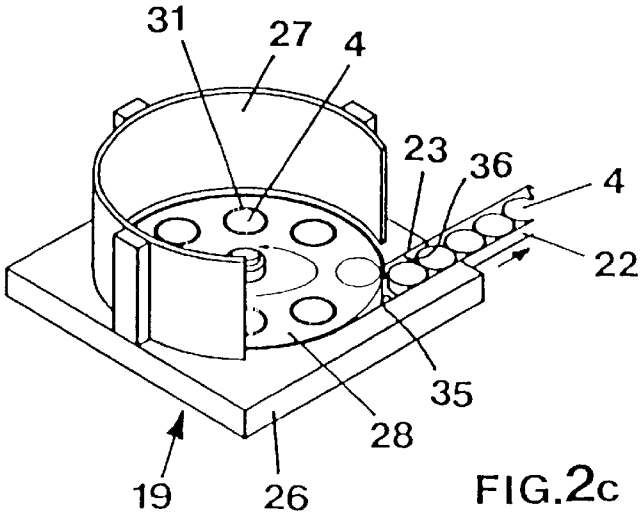
FIG. 2*c* shows, schematically, a lateral front view of the pushing device according FIG. 2*a,*
Figure 2A:
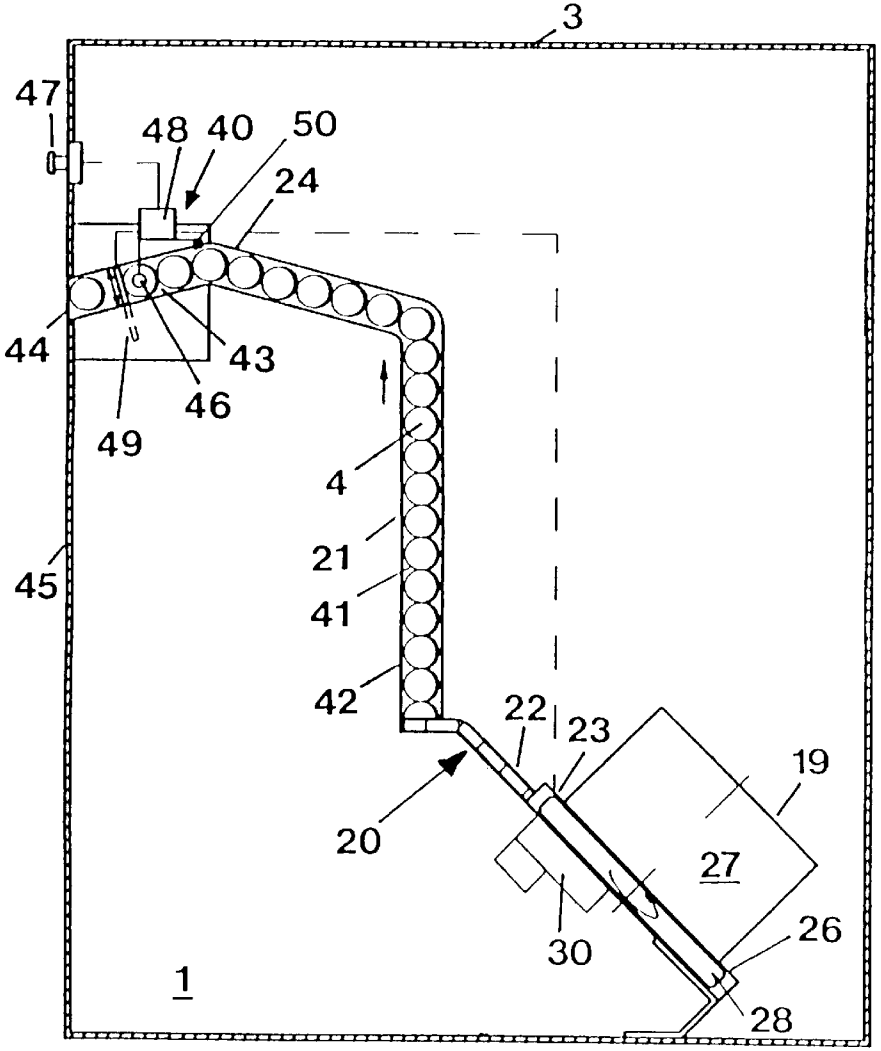
FIG. 2*a* shows, schematically and partially in section, a front view of an entrance-control station.

As required, car-park tickets which have been retrieved from this supply container 27 of the dispenser 20 are separated and fed to the issuing apparatus 40 in a pushed group which can be moved forwards, a vertical difference being surmounted in the process, and the returned car-park tickets 4 can be issued again if required from said issuing apparatus 40. FIGS. 2*a* to 2*c* show an entrance-control station 1, which differs from that described above only by the fact that this one is not coupled to a departure-control station. The supply container 27 of the dispenser 20 is filled here in a batchwise manner, manually or otherwise, with car-park tickets 4 provided for issuing. Accordingly, the above described method of operation of the dispenser 20 does not depend on the manner of filling the supply container 27, from which the dispenser 20 conveys.

The parking barrier 18 illustrated in FIG. 2*b* may be connected to the control device 48, which controls the opening and closing of the parking barrier 18 in dependence on the issuing of a car-park ticket 4.

The invention now being fully described, it will be apparent to one of ordinary skill in the art that many changes and modifications can be made thereto without departing from the spirit or scope of the appended claims.

What is claimed is:

1. A dispenser for disc-shaped car-park tickets, in particular for installation in an entrance-control station of a multi-storey car park or of an open-air car park, comprising a supply container for car-park tickets, an issuing apparatus for car-park-ticket removal, and a conveying device running between the supply container and the issuing apparatus, the conveying device comprising a pushing device, with supply container positioned thereon, and a transporting duct, which guides the car-park tickets and an outlet of which adjoins the issuing apparatus, and at least one ascending section of the transporting ducts adjoins an outlet of the pushing device for receiving a group of car-park tickets which are located one above the other under the action of gravity, the pushing device receiving car-park tickets and exerting a pushing movement on the lowermost car-park ticket in the group, which lowermost car-park ticket is conveyed through the transporting duct by means of a car-park-ticket stream, the pushing device being activated depending on a fill level in said issuing device which is provided with a fill-level monitor being connected to a control device actuating the pushing device.

2. A dispenser according to claim 1, wherein the transporting duct has dimensions which prevent car-park tickets tipping over from an upright position as they move through the transporting duct by sliding or rolling.

3. A dispenser according to claim 1, wherein the pushing device is designed as a driving plate with a supply container positioned thereon.

4. A dispenser according to claim 3, wherein the driving plate comprises a car-park-ticket-separating device which repeatedly conveys in each case one car-park ticket into the transporting duct.

5. A dispenser according to claim 1, wherein the pushing device comprises a rotatable car-park-ticket intercepting and driving disc which conveys the car-park tickets separately along a curved guide path ending with a discharge section in to the transporting duct.

6. A dispenser according to claim 5, wherein the car-park ticket-intercepting and driving disc comprises a perforated disc with a plurality of concentrically arranged holes, the hole diameter slightly exceeding the diameter of the car-park tickets, and the perforated disc having, on its rear side facing the guide path, guide webs which project around each hole in a mouth-like manner and which have a border-side mouth opening for discharging a car-park ticket and which have between two mouth openings portions which, when the perforated disc rotates, push into the transporting shaft those car-park tickets which have dropped through one of the holes into the guide path.

7. A dispenser according to claim 6, wherein the guide webs have a depth which projects at least partially into the guide path and corresponds at least to the thickness of the car-park tickets, with the result that the car-park tickets which have dropped through a respective hole can be guided, and pushed beneath the perforated disc into the discharge section, by means of the guide webs.

8. A dispenser according to claim 7, wherein the pushing device is set up in an obliquely upright manner and adjoining the transporting duct at the top end.

9. The dispenser as in 1, wherein the guide path is curved so as to follow the rotary movement of the perforated disc, and the guide path being formed by a partially circular path from which the outlet of the pushing device extends tangentially.

10. The dispenser as in claim 1, wherein the guide path is overlapped at the top by the perforated disc, and has dimensions which make it possible for the car-park tickets to lie flat as they are conveyed to the outlet.

11. A dispenser according to claim 1, wherein the fill-level monitor detects the presence of one or more car-park tickets.

12. A dispenser as in claim 11, wherein the control device further provides control of a parking barrier in relation to the issuance of a car-park ticket.

13. A dispenser according to claim 1, wherein said issuing device comprises a downwardly directed shaft which defines a buffer for a number of car-park tickets to be issued and contains said fill-level monitor.

14. A dispenser according to claim 1, wherein said issuing device actuates said control device depending on the issuing of each car-park ticket.

* * * * *